United States Patent [19]

Murphy

[11] 4,019,297

[45] Apr. 26, 1977

[54] CONSTRUCTION PANEL

[75] Inventor: William F. Murphy, Marshall, Ill.

[73] Assignee: David V. Munnis, Champaign, Ill. ; a part interest

[22] Filed: Oct. 14, 1975

[21] Appl. No.: 621,793

Related U.S. Application Data

[63] Continuation-in-part of Ser. No. 491,283, July 29, 1974, abandoned.

[52] U.S. Cl. ..... 52/309.2; 52/454; 52/601; 52/612; 52/348

[51] Int. Cl.[2] ..... E04B 1/26

[58] Field of Search ..... 106/90, 93, 97, 116, 106/DIG. 3; 260/2.5 B, 2.5 HB; 52/309, 348, 454, 405, 601, 612

[56] References Cited

UNITED STATES PATENTS

| | | | |
|---|---|---|---|
| 1,460,682 | 7/1923 | Schleicher | 52/600 |
| 2,094,248 | 9/1937 | Vicenzi | 52/454 |
| 2,104,869 | 1/1938 | Levy | 52/454 |
| 2,704,935 | 3/1955 | Uddenborg | 52/601 |
| 3,257,338 | 6/1966 | Sefton | 260/2.5 B |
| 3,272,765 | 9/1966 | Sefton | 260/2.5 B |

*Primary Examiner*—John E. Murtagh
*Attorney, Agent, or Firm*—David V. Munnis

[57] ABSTRACT

A construction panel for incorporating into a building or house structure; the construction panel being comprised of a frame consisting of spaced apart vertical studs and transverse top and bottom plates wider than said studs, an insulation board secured to one face of the frame and within a cavity formed by said plates and studs and an, in situ laid concrete-like composition layer comprising expanded mica, expanded polystyrene, and mortar cement applied to the exposed, outwardly facing side of said insulation board, the concrete-like composition layer having a filament mesh reinforcement imbedded therein, the construction panel being manufactured in a plant and transported to a construction site where it is simply installed. Also a novel concrete-like composition useful in producing formed objects, including construction panels.

5 Claims, 5 Drawing Figures

CONSTRUCTION PANEL

RELATED APPLICATIONS

This application is a continuation-in-part application of applicant's copending application, Ser. No. 491,283, filed July 24, 1974, now abandoned.

BACKGROUND AND OBJECTS

This invention relates generally to building construction panels.

A principal object of the present invention is to provide a novel construction panel to be used for a very quick erection of houses, small offices or buildings.

Another object of the present invention is to provide a construction panel which is manufactured at plant site and then transported in a finished condition to a construction site where it is simply installed on any existing floor system, e.g., either a wood floor system or a concrete floor.

Still another object of the present invention is to provide a construction panel that incorporates insulation in place, giving it an R-12 insulation rating which is suitable for electric heating.

Other objects of the present invention are to provide a construction panel which is simple in design, inexpensive to manufacture, rugged in construction, easy to install and efficient in operation.

These and other objects will be readily evident upon a study of the following specification and the accompanying drawing, wherein.

Figure 1:
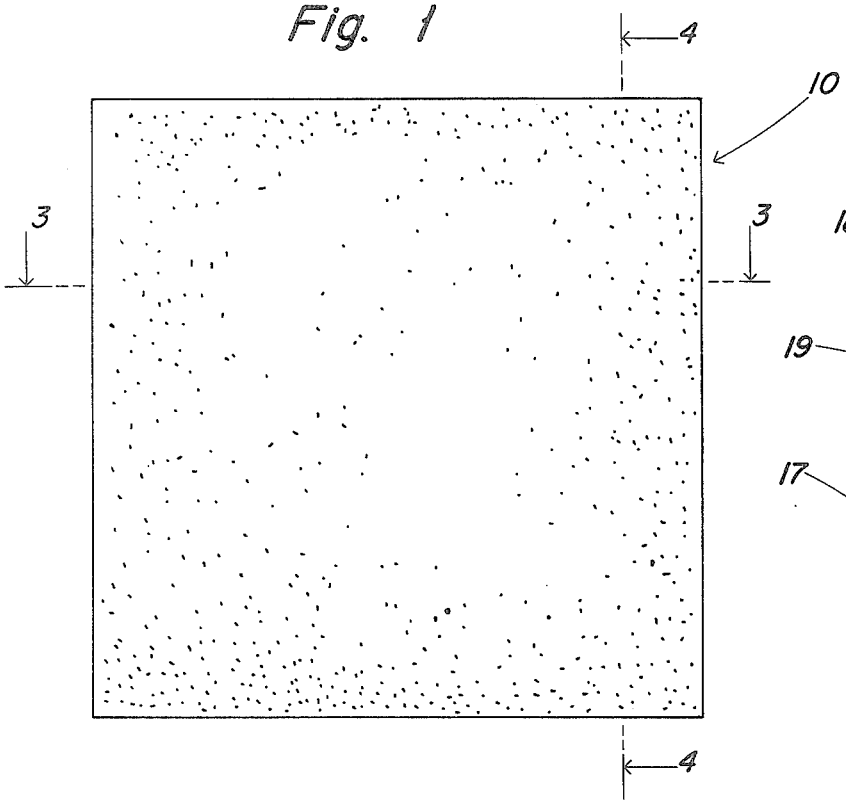
FIG. 1 is an outside view of an embodiment of the construction panel.

Referring now to the drawings in detail, the numeral 10 generally represents a construction panel according to the present invention wherein the same includes generally a frame 11 which is constructed of a plurality of spaced apart studs 12 which at their upper ends are abutted and joined by means of a transverse extending top plate 13 and which at their lower ends are abutted and joined by means of a transverse extending bottom plate 14. The ends of plates 13 and 14 and sides of the first and last studs 12 form flush surfaces. The studs and plates suitably may be formed of any conventional and available building material such as wood, metal, et., but preferably are of wood. The frame is assembled by a plurality of fastening means 15, such as nails, screws, bolts, etc.

The particular lengths of studs 12 and plates 13 and 14 are not critical. The studs and plates may be of the same length, e.g., 2 feet, 4 feet, 8 feet, etc. to produce ultimate panels which essentially square, or either one or more studs may be either longer or shorter than the plates to produce rectangular or "stepped" panels.

The particular cross-sectional sizes of studs 12 and plates 13 and 14, likewise, are not critical, although the size of the material employed for studs 12 preferably is such that it has a strength in compression at least equivalent to 2 in. × 2 in. pine of the same length and the size of the material employed for plates 13 and 14 preferably is such that it displays a strength in compression at least equivalent to 2 in. × 4 in. pine of the same length.

Plates 13 and 14 in the panels of the present invention, do have a dimension (i.e. depth), transverse the ends of studs 12, which is greater than that of studs 12. This is to allow plates 13 and 14 to overlap the ends of studs 12 in the direction of the ultimate outward face of the panels in order to receive and provide in said region an insulation board-backed facing of light, hard concrete-like composition, as described hereinafter. This overlapping suitably may be such to provide, after application of an intermediate insulation board backing, cement-like facing of at least 0.5 in. and more preferably in the range of from about 1 in. to about 2.5 inches.

Studs 12 of the panels should have at least 1 in. depth, i.e., in the direction of the thickness of the panel, be adapted to receive, in the spaces between adjacent studs and rearward of said insulation board backing for said concrete-like facing, sheets of supplemental insulating material having a thickness of at least 1 in. Any sheet insulating material can be employed for such supplemental insulation including sheets of fiber board, press board, expanded poly styrene, fiberglass, etc., the particular insulating material preferred depending upon the overall design and ultimate use of the panel, but preferably adapting said panel for overall use with all heating systems, including electrical heating systems.

Figure 4:
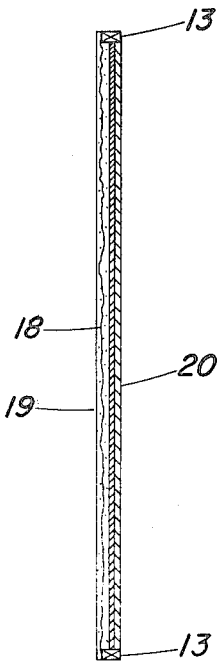
FIG. 4 is a side cross-sectional view on line 4—4 of FIG. 1.

For home construction, for example, the studs may comprise conventional 2 in. × 2 in. wooden members with a 1.5 inch styrene insulation strips disposed rearwardly between adjacent studs. For a practical size, the studs may be made eight feet in length. The top and bottom plates may be 2 in. × 4 in. wooden members, likewise eight feet in length, and are nailed to the studs to form a frame in which the side and back surfaces are flush. Upon the front side of the frame 11 thus formed, a 0.5–0.75 in. × 8 ft. × 8 ft. insulating fiber board 16 is secured to the studs by means of nails 17 within the resultant "cavity" formed by the studs and plates. In this respect it will be noted that the frame 11 has the top plate 13 and bottom plate 14 made of 2 in. by 4 in. wood so that, when they are secured, with the respective side and back faces of the studs and plates being flush with each other, the top and bottom plates 13 and 14 extend forwardly about 2 in., as is evident in FIG. 4 and as is more clearly shown in FIG. 5. Accordingly, the 0.75 in. insulating fiber board 16 is fitted between the top and bottom plates while being secured by fasteners, e.g. nails 17 to the studs 12. Board 16 will then serve as a base on which the concrete-like composition facing 19 is applied to the panel, as herein described.

Figure 5:
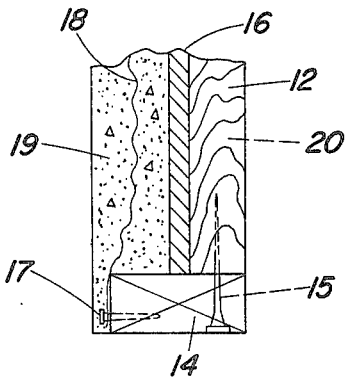
FIG. 5 is an enlarged fragmentary detail of the lower end of the structure shown in FIG. 4.
Figure 2:
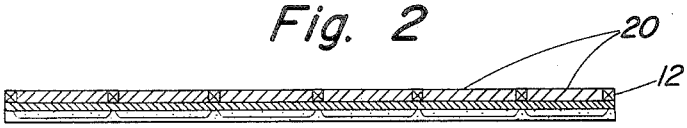
FIG. 2 is a transverse cross-sectional view thereof.
Figure 3:
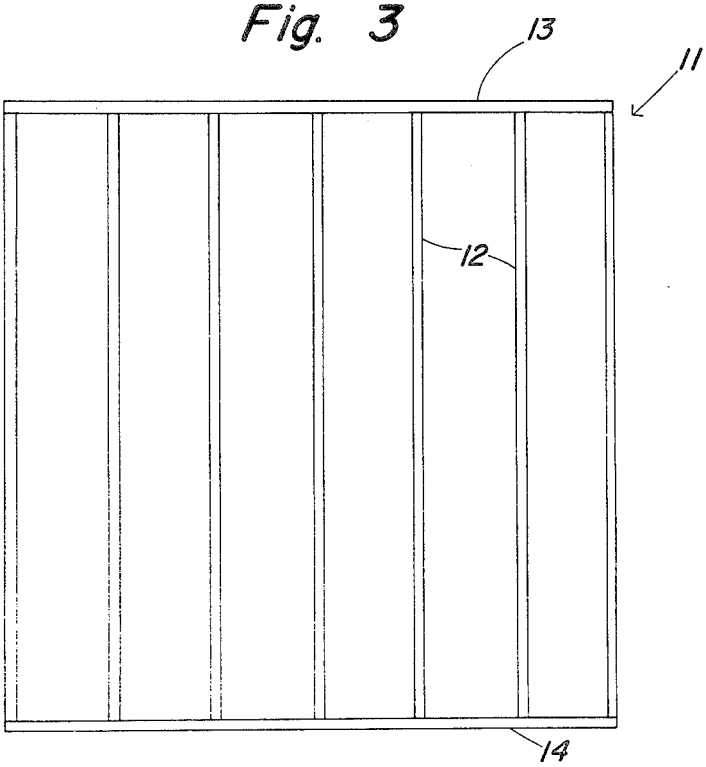
FIG. 3 is an elevation view of the construction panel frame consisting of studs, top plate and bottom plate.

A filament mesh reinforcement 18 is then secured to the face of the frame structure 11 by means of fasteners, e.g., nails 17, as shown in FIG. 5 so that it attaches directly to the outside-facing faces of plates 13 and 14 extending beyond studs 12 and comprises a rigid element of the structure.

Filament mesh reinforcement 18 suitably may be formed of any conventional and available reinforcing mesh, including woven webs formed of metal (e.g. steel), plastic, (e.g. nylon) and the like filaments of a diameter in the range of from about 0.05 in. to about 0.20 in. Thereafter, a concrete-like composition layer 19 is applied against the side and over the entire surface of the insulating fiber board adjacent to the mesh reinforcement and over the entire surfaces of the faces of plates 13 and 14 where mesh 18 is attached so that the mesh reinforcement totally is imbedded within the concrete layer and the outwardly-facing surface of the panel is provided by said layer 19.

In applying concrete-like face layer 19, auxiliary forms not shown, which are removably brought into position adjacent the extreme outside faces of end studs 12 and plates 13 and 14, may be, and preferably are, employed to ensure and aid in the uniform covering of the outside faces of such members with concrete-like composition layer, as shown in FIG. 1, while providing, at the four edges of a panel, material (i.e., studs and end member faces) by which the panel can be nailed, screwed, bolted, etc., are essential features of the panels of the present invention. Thereby, individual or a plurality of panels can be be erected alone or adjacent each other to provide an outward exposed surface of only said concrete-like composition.

In accordance with said invention, it surprisingly was discovered that the objects of the invention could be achieved by employing as the facing material, a moldable, autogenously hardinable paste comprising, in admixture, concrete cement, from about 0.75 to about 2.5, more preferably from about 1 to 1.5, parts by volume expanded mica per part said cement, from about 0.75 to about 2.5, more preferably from about 1 to about 1.5, parts by volume particulate expanded polystyrene per part said cement and water.

It was found that such compositions advantageously provided strong, yet light construction panels, which maintained their appearance and integrity, i.e., did not crack, even around the edges adjacent the faces of the plates and studs, where the facing layer is relatively thin. Surprisingly, 8 ft × 8 ft. panels of the desired strength, appearance, and weatherability were produced, for example, using 8 ft. × 2 in. × 2 in. studs and 8 ft. × 2 in. × 4 in. plates and the described facing composition, at total panel weights in the range from about 375 to about 440 pounds, such panels being easily handled by two men at an erection site.

In the preferred embodiments of the invention the expanded mica utilized has a bulk density in the range of from about 3.5 to about 10, and more preferably from about 4 to about 8, pounds per cubic foot, and the particulate expanded polystyrene utilized is that having a bulk density in the range of from about 0.8 to about 1.2, and more particularly from about 0.9 to about 1.1 pounds per cubic foot and produced by hammermilling with a 0.75 in screen.

The resultant panels produced by the present invention may be employed as such or may be, and preferably are, further surface coated with a topping composition comprising a binder, e.g., masonry cement, some aggregate, such as gravel, stone chips, and the like, and even bricks or stone slabs, with or without a coloring agent, to impart on a more ornamental effect to the surface.

While the above has been limited to a description of the use of the concrete-like composition of the present invention in construction panels, it will be understood that the present invention includes and embraces such composition, per se, and such composition as employed in providing molded, lightweight, objects generally, e.g., surfaces, such as patios, sidewalks, floorings, etc; sculptured objects; boat hulls, etc.

What is claimed is:

1. A separately transportable, masonry-faced construction panel comprising (1) a frame, wherein said frame is comprised of a plurality of parallel, spaced apart vertical studs, a transverse top plate across the upper ends of said studs, and a transverse bottom plate across the bottom ends of said studs, said studs and plates being secured together and positioned relative to each other such that the respective adjacent side and back faces thereof are flush with each other and such that the front faces of said plates extend forwardly farther than do the front faces of said studs, said plates having a depth dimension which is greater than that of said studs, (2) an insulating fiber board panel secured to and covering the front faces of said studs within the resultant cavity formed between said plates, (3) a mesh of filament covering the faces of said fiber board opposite said studs and the front faces of said plates of said frame adjacent said fiber board, and (4) an in situ formed crack-free concrete-like facing layer on said fiber board, said facing layer containing said filament mesh imbedded therein and completely covering the front surface of said frame on the side thereof to which said mesh is attached, said facing layer being formed by applying an autogenously hardenable paste consisting essentially of concrete cement, from about 0.75 to about 2.5 parts by volume expanded mica per part said cement, from about 0.75 to about 2.5 parts by volume particulate expanded polystyrene per part said cement, and water, and allowing said applied paste to harden to form thereby one entire face of the resultant panel.

2. The panel of claim 1, wherein said frame is comprised of a plurality of parallel, spaced apart vertical studs made of wood, a transverse top plate across an upper end of said studs and a bottom plate of wood across a bottom end of said studs.

3. The panel of claim 1, wherein said filament mesh is formed of metal wire.

4. The panel of claim 1, wherein the back side of said fiber board removed from said facing layer is covered with sheets of supplemental insulating material.

5. The construction panel according to claim 1 wherein said facing layer is surface coated with an ornamental masonry topping composition.

* * * * *